US006052971A

United States Patent [19]

Malsam et al.

[11] Patent Number: 6,052,971

[45] Date of Patent: Apr. 25, 2000

[54] OFFSET STRIPPER AND STRIPPING METHOD FOR VERTICAL FORM, FILL AND SEAL MACHINE

[75] Inventors: James Henry Malsam, Woodruff, S.C.; Larry Gene Swan, Marietta, Ga.

[73] Assignee: Hayssen, Inc., Duncan, S.C.

[21] Appl. No.: 09/188,644

[22] Filed: Nov. 9, 1998

[51] Int. Cl.[7] ..... B65B 9/00; B65B 9/06

[52] U.S. Cl. ..... 53/451; 53/552; 53/526

[58] Field of Search ..... 53/451, 551, 552, 53/374.8, 374.3, 374.5, 374.6, 526, 527, 528; 493/302

[56] References Cited

U.S. PATENT DOCUMENTS

| | | | |
|---|---|---|---|
| 4,391,081 | 7/1983 | Kovacs | 53/552 |
| 4,757,668 | 7/1988 | Klinkel et al. | 53/451 |
| 5,203,145 | 4/1993 | Kammler et al. | 53/552 |
| 5,377,474 | 1/1995 | Kovacs et al. | 53/551 |
| 5,485,712 | 1/1996 | Cherney et al. | 53/552 |
| 5,575,137 | 11/1996 | Metz et al. | 53/552 |

*Primary Examiner*—John Sipos
*Assistant Examiner*—Steven Jensen
*Attorney, Agent, or Firm*—Lee, Mann, Smith, McWilliams, Sweeney & Ohlson

[57] ABSTRACT

An apparatus and method for stripping the end seal area in a vertical form, fill and seal machine. First and second wiper members are secured to the sealing jaws and extend toward the film tube being formed, filled and sealed. The wiper members have engagement portions vertically staggered or offset from one another which engage opposite sides of the film tube for the purposes of stripping. The stripping apparatus and process can be used with intermittent machines which use film reversal for stripping, as well as continuous motion machines which always advance the film in the forward direction.

17 Claims, 11 Drawing Sheets

1) Sealing - Matched Speed
2) Open Jaws - Decelerate Film Velocity
3) Decelerate Jaws to 0 velocity
4) Accelerate Jaws in Return Direction
5) Jaw Cruise return velocity
6) Decelerate jaws to 0 velocity
7) Accelerate jaws to strip velocity
8) Decelerate jaws to pull velocity

OFFSET STRIPPER AND STRIPPING METHOD FOR VERTICAL FORM, FILL AND SEAL MACHINE

BACKGROUND OF THE INVENTION

This invention relates to vertical form, fill and seal machines, and in particular to such machines employing stripping of the end seal area. The invention provides a unique means of stripping utilizing staggered wiper members and a unique method of stripping the end seal area.

For many years, manufacturers of vertical form, fill and seal machines have been concerned about seal quality of the packages formed in the equipment. This concern is particularly relevant in the end seal where it is possible for packaged product to be trapped between the surfaces of the sealing jaws when the jaws close to complete the end seals. The trapped product keeps the film surfaces from achieving intimate contact for sealing, and the result is an open or partially open package. This is a particularly serious problem when the product in the package is a food product subject to spoilage or contamination. The problem is worsened when the package is being formed to contain an inert gas for preservation of the product and thus when the integrity of the seal must be without question.

Many stripping devices have evolved over the years. One such device is described in U.S. Pat. No. 4,391,081, assigned to Hayssen Manufacturing Company and now owned by the owner of the present application. This patent discloses a stripping mechanism which is capable of reaching between the open sealing jaws, closing on the film tube, and moving downwardly to force product into the bag below the end seal area before the sealing jaws are closed. The '081 patent is an improvement over the vertical form, fill and seal apparatus disclosed in U.S. Pat. No. 4,288,965 which is also owned by the assignee of the present application.

With the development of servo motor technology, vertical form, fill and seal machines were made more versatile. Servo technology allowed the stripping to take place by first pulling a bag longer than the ultimately-desired package length. Then, the sealing jaws, or other stripping mechanism, are engaged and the film is pulled in the reverse direction through the jaws or the stripping mechanism to strip the end seal area. Such a method is described in U.S. Pat. No. 5,485,772 which is also owned by the assignee of the present invention. A mechanical means for accomplishing the same goal is described in Klinkel U.S. Pat. No. 4,757,668.

With the advent of high speed equipment with a continuously advancing film tube, the stripping process has been made somewhat more complex, but still similar to the reverse stripping process in that the film tube is stripped vertically through the end seal area. In a continuous motion machine, the sealing jaws follow the film for a portion of the bag making cycle, and stripping is accomplished by partially closing the sealing jaws or engaging the stripping mechanism, and then overrunning the film tube for a brief period of time in order to strip the end seal area. The jaws are then closed following stripping to complete formation of the package. In this manner, product is forced into the package while the film is always being pulled in a forward direction, and reversing of the film pull direction is unnecessary.

In all known stripping apparatus and methods, the stripping mechanism employs a series of moving parts. The parts are expensive, and must be properly sized and timed in operation so as not to interfere with the sealing jaws. It is an important advantage to provide a stripping mechanism and method which employs a stripping means having no moving parts.

SUMMARY OF THE INVENTION

The invention relates to a vertical form, fill and seal apparatus which comprises a source of web of flexible packaging material, a device for forming the web into a tube, means for pulling the film through the apparatus, and a mechanism for sealing and severing the tube into discrete packages. The sealing and severing mechanism includes a pair of sealing jaws spaced on opposite sides of the tube, with at least one of the sealing jaws being movable horizontally toward and away from the other sealing jaw. Wiper means is provided, the wiper means comprising first and second wiper members, one of the wiper members being secured to each of the sealing jaws and extending toward the tube, with the wiper members having engagement portions vertically offset from one another. Means is provided for relative movement of the wiper means and the tube upon engagement of the wiper members for stripping of the tube.

In accordance with the preferred form of the invention, each of the wiper members includes an arm having a predetermined length. The arms comprise the engagement portions which are vertically offset from one another.

The offset portions of the arms must be vertically separated from one another by a gap sufficient to accommodate the collapsed tube therebetween when the wiper members are engaged. The amount of clearance between the arms will depend on the type of web or film being used, the type of material being stripped, and the desired integrity of the horizontal end seal being formed.

In one form of the invention, the means for pulling includes a pair of pull belts which engage the tube and pull the tube in a forward direction. The means for relative movement comprises means for reversing the pull belts to pull the tube in a reverse direction during stripping. In another form of the invention, the sealing jaws are moveable vertically, and the means for relative movement comprises means for moving the sealing jaws at a greater vertical velocity than that of the advancing film tube.

In the stripping process according to the invention, the first and second wiper members are brought into proximity by closing of the sealing jaws to collapse the tube between the ends of the wiper members. The wiper means and the tube are then moved relative to one another to strip the end seal portion of the tube. The sealing jaws are then fully closed to seal and sever a package from the tube, with the engagement portions of the first and second wiper members overlapping one another. The sealing jaws are then opened to release the package, and the process is repeated.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
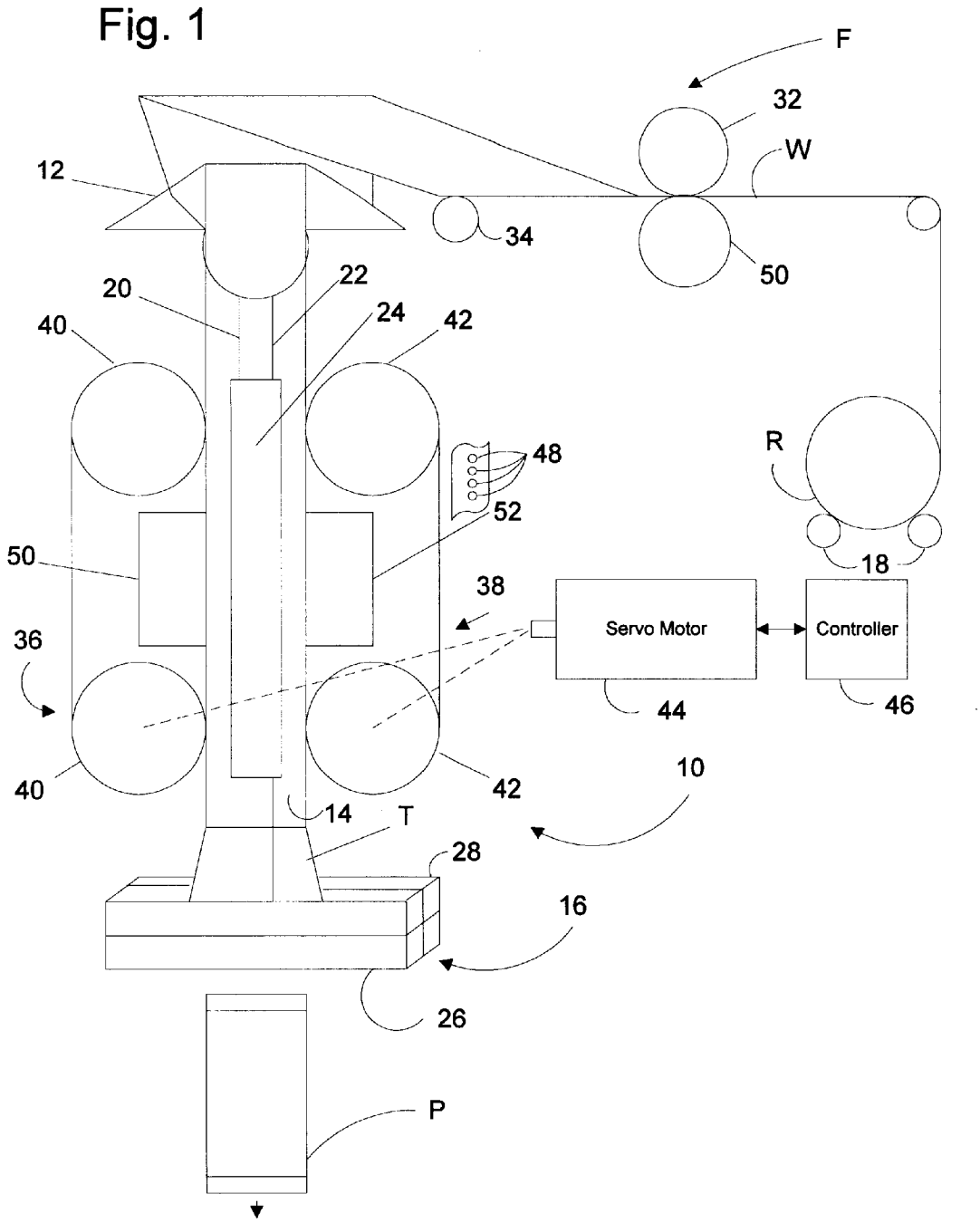
FIG. 1 is a schematic perspective illustration of a vertical form, fill and seal machine in accordance with the invention, illustrating the salient aspects of a vertical form, fill and seal machine while eliminating unnecessary conventional detail.

An apparatus according to the invention is generally depicted at 10 in FIG. 1. The apparatus 10 is preferably a vertical form, fill and seal machine such as that depicted and described in U.S. Pat. Nos. 4,288,965; 4,391,081 and 5,485,712, the disclosures of which are incorporated herein by reference. In the apparatus 10, a web W of flexible packaging material, such as a plastic film, is pulled from a supply R in the form of a roll. The web W is fed over a forming shoulder 12 for forming the web into a film tube T about a forming tube 14 which extends below the forming shoulder 12. Product to be packaged is then inserted through the forming tube 14 into the film tube T in a conventional fashion, and sealing is then performed on the film tube T as generally indicated by a sealing apparatus 16, sequentially forming a series of packages P. The roll R of film may be supported in a customary fashion on a pair of support rollers 18, or by other means.

The forming shoulder 12 forms the web W of plastic film into the film tube T with longitudinal margins 20 and 22 of the web W in an overlapping relationship, and then directs the tube downwardly about the vertically-extending forming tube 14 beneath the forming shoulder 12. A lap sealer 24, shown diagrammatically in FIG. 1, is used for sealing the overlapping margins 20 and 22 to provide a longitudinal seal in the tube T. Product is introduced into the tube T in a conventional fashion, and the tube T is then transversely sealed at desired package length intervals by the sealing apparatus 16. Preferably, the sealing apparatus 16 consists of opposite pairs of sealing jaws or dies 26 and 28, each operable at least along a horizontal plain in order to form a top seal for the package P being completed and a bottom seal for the next package to be formed. The sealing dies 26 and 28 typically incorporate conventional cutting means for transversely severing the tube T between the seals made by the upper and lower portions of the sealing dies 26 and 28.

The web W is intermittently withdrawn from the supply role R and can be fed through a dancer roll assembly (not illustrated) for accommodating slack in the web W. The web W is fed through a measuring axis F, composed of a lower measuring roll and an upper measuring roll 32. A servo motor or other means (not illustrated) can be used for driving the rolls 30 and 32. The web W then travels from the measuring rolls 30 and 32 under a guide roll 34 and then up to and over the forming shoulder 12. The web W is pulled over the forming shoulder 12 under tension by a pair of pull belts 36 and 38 which press the film against the forming tube 14. The pull belt 36 is mounted about a pair of rollers 40, and the pull belt 38 is mounted about a pair of rollers 42. The pull belts 36 and 38 are driven by one or more servo motors 44 connected to the rollers 40 and 42. The servo motor 44 is, in turn, controlled in a conventional fashion by a servo controller 46.

Typically, in order to enhance the grip of the pull belts 36 and 38 on the advancing tube T, the pull belts 36 and 38 are provided with a series of holes 48. Vacuum plenums 50 and 52 create a vacuum through the passing holes 48, increasing adherence between the surfaces of the pull belts 36 and 38 and the tube T.

All of the foregoing is a basic description of what can be a conventional vertical form, fill and seal apparatus, and is therefore not described in greater detail. The invention of the present application is directed to stripping of the tube T during the sealing and severing operation to form the packages P.

Figure 2:
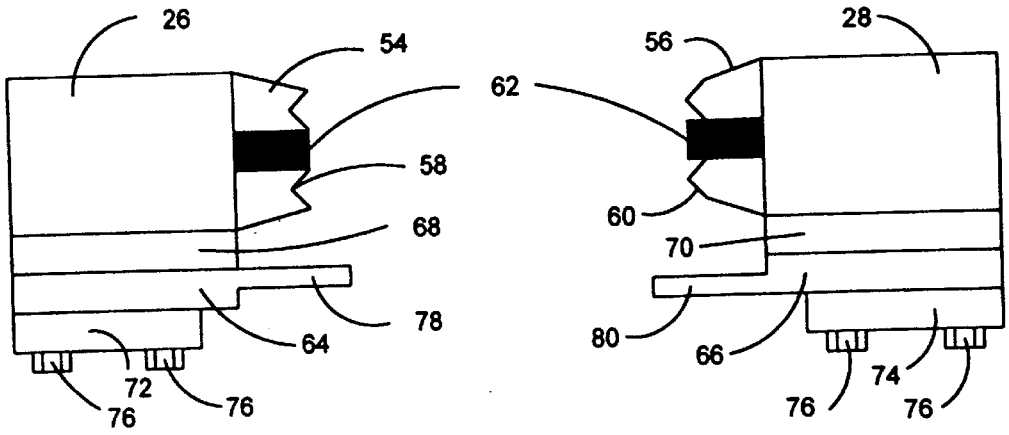
FIG. 2 is an elevational illustration of the sealing jaws of FIG. 1, showing the wiper members according to the invention secured beneath the sealing jaws.

Turning to FIG. 2, illustrated is an elevational view of the sealing apparatus 16 in greater detail. Each of the sealing dies 26 and 28 has respective upper sealing surfaces 54 and 56 and lower sealing surfaces 58 and 60. In a conventional fashion, heat is supplied to the sealing surfaces 54 through 60 at appropriate intervals to seal portions of the tube T to form successive packages P. A knife assembly 62 is situated between the upper sealing surfaces 54 and 56 and lower sealing surfaces 58 and 60 for periodic severing of the tube T as the packages P are completed. Appropriate servo motors (not illustrated) or other means can be used to drive the sealing dies 26 and 28 in a conventional fashion.

The wiper means according to the invention comprises first and second wiper members which are secured beneath each of the sealing jaws 26 and 28. The wiper members comprise arms 64 and 66 which extend outwardly from the sealing jaws as illustrated. The arms 64 and 66 are sandwiched between respective insulators 68 and 70 and backing plates 72 and 74. A series of mounting screws 76 are utilized to secure the arms 64 and 66, insulators 68 and 70, and backing plates 72 and 74 beneath the respective sealing jaws 26 and 28. While use of the insulators 68 and 70 is preferred in order to insulate the arms 64 and 68 from the heated sealing jaws 26 and 28, use of the insulators 68 and 70 is not mandatory.

As illustrated in FIG. 2, the arms 64 and 66 are preferably identical, one of the arms 64 and 66 being inverted in relation to the other of the arms. The arms therefore have engagement portions 78 and 80 which are vertically offset or staggered from one another, as best shown in FIGS. 3E and 4E. When the engagement portions 78 and 80 overlap one another, a sufficient gap between the engagement portions must be provided to accommodate the collapsed tube T therebetween without damaging the material of the tube. While a minimum gap is shown in the drawing figures, the gap can obviously be increased, depending on the material in the web W, the type of product being stripped from the end seal area in the tube T, and the proximity to which the arms 64 and 66 are brought during the stripping process (FIGS. 3C and 3D, 4C and 4D described below).

FIGS. 3A through 3F illustrate the sequence of steps for stripping, sealing and severing a package P from the tube T using the reverse stripping process, where the sealing jaws 26 and 28 are reciprocated on horizontal paths without being moved vertically in relation to the remainder of the apparatus 10. The pull belts 36 and 38 are reversed to reverse the direction of the tube T for stripping.

Figure 3A:
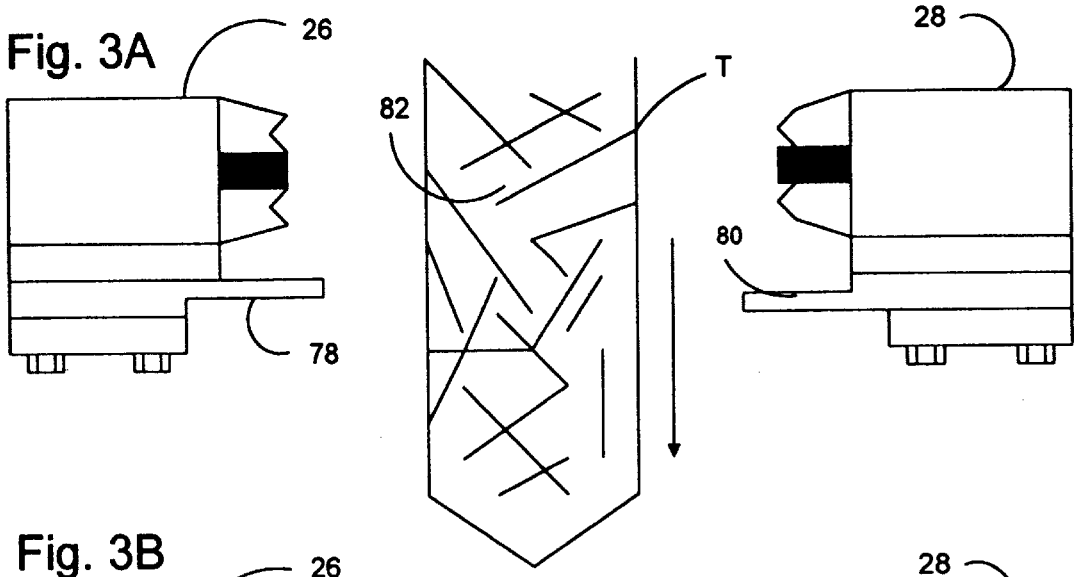
FIGS. 3A through 3F depict the various steps of filling, stripping, sealing and severing a package according to the invention, when utilizing a reverse stripping operation.

In FIG. 3A, the sealing jaws 26 and 28 are fully open, and the tube T is advancing therebetween, having either been filled with product 82 or in the process of being filled. The direction of travel of the tube T is indicated by the arrow.

Figure 3B:
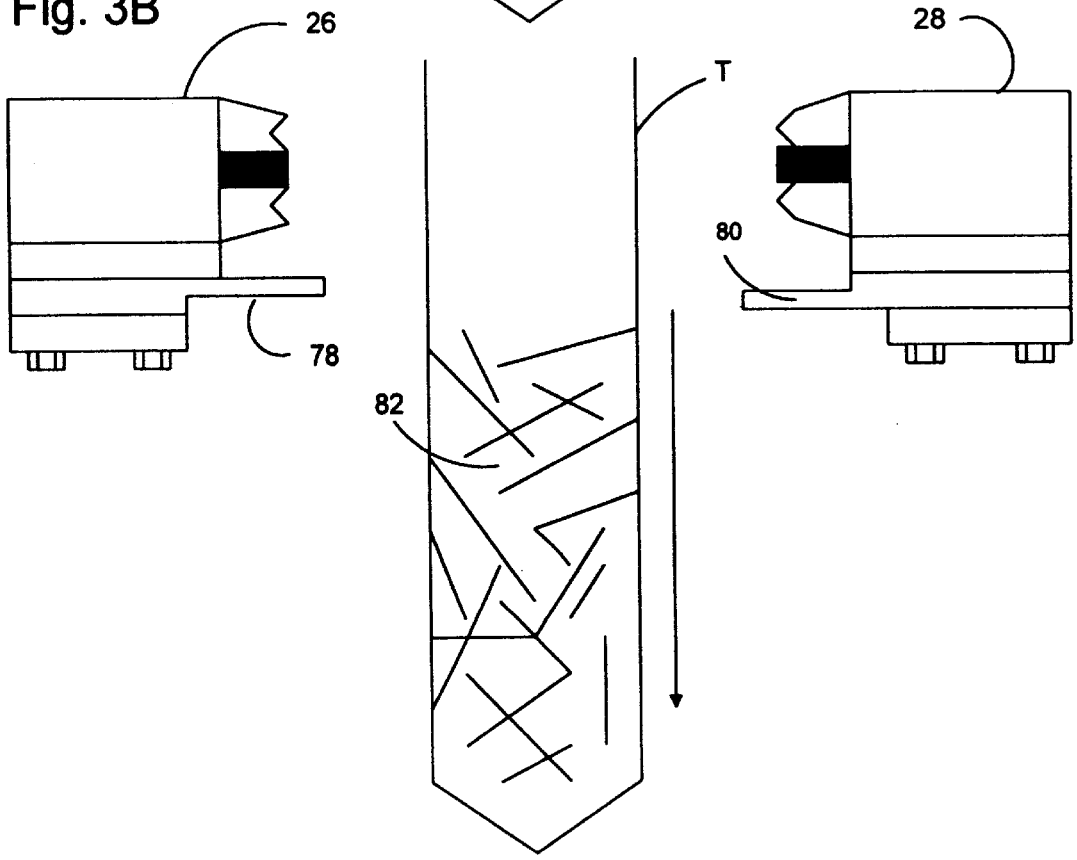

In FIG. 3B, the tube T has been pulled past the sealing jaws 26 and 28 a distance which represents the normal length of the package P, plus a fixed stripping distance through which the tube T is reversed for stripping purposes. At this point, horizontal partial closing of the sealing jaws 26 and 28 begins.

Figure 3C:
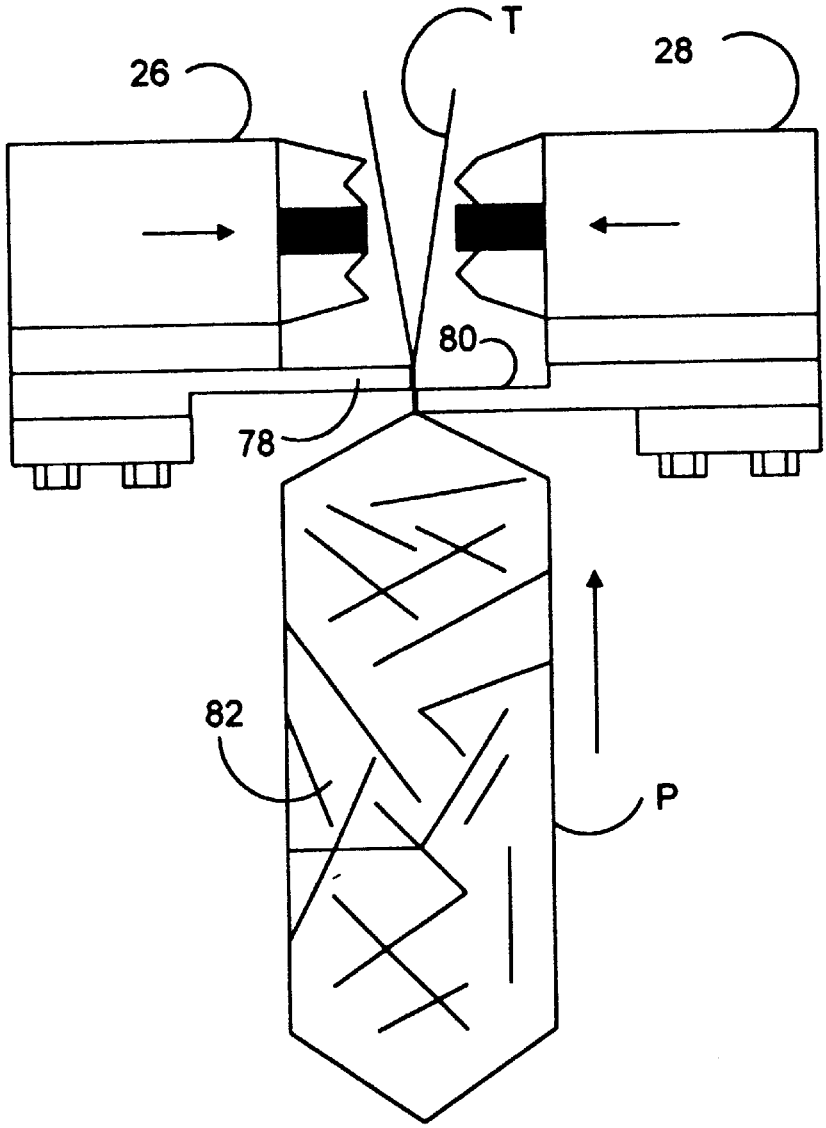

In FIG. 3C, the sealing jaws 26 and 28 have been partially closed with the engagement portions 78 and 80 staggered but in proximity to one another, and with the tube T collapsed therebetween. As soon as the sealing jaws 26 and 28 are partially closed, the pull belts 36 and 38 are reversed, reversing the direction of the tube T for a distance equal to the desired stripping distance of the end seal area. Any product 82 is forced into the package P by the engaged engagement portions 78 and 80, thus clearing the end seal area.

Figure 3D:
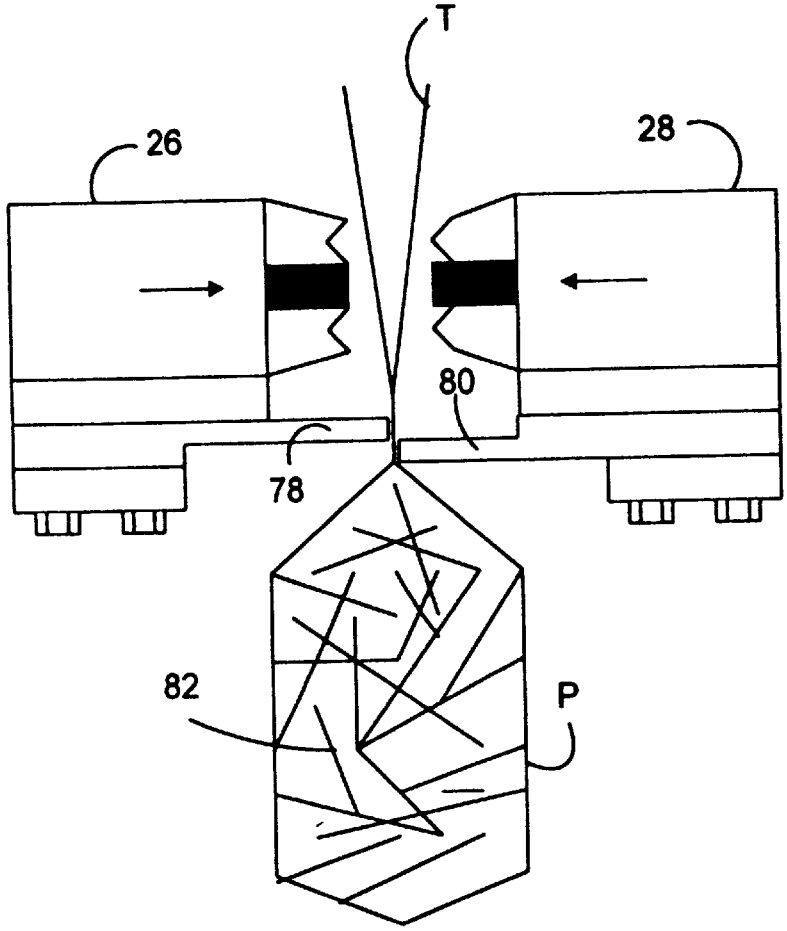
Figure 3E:
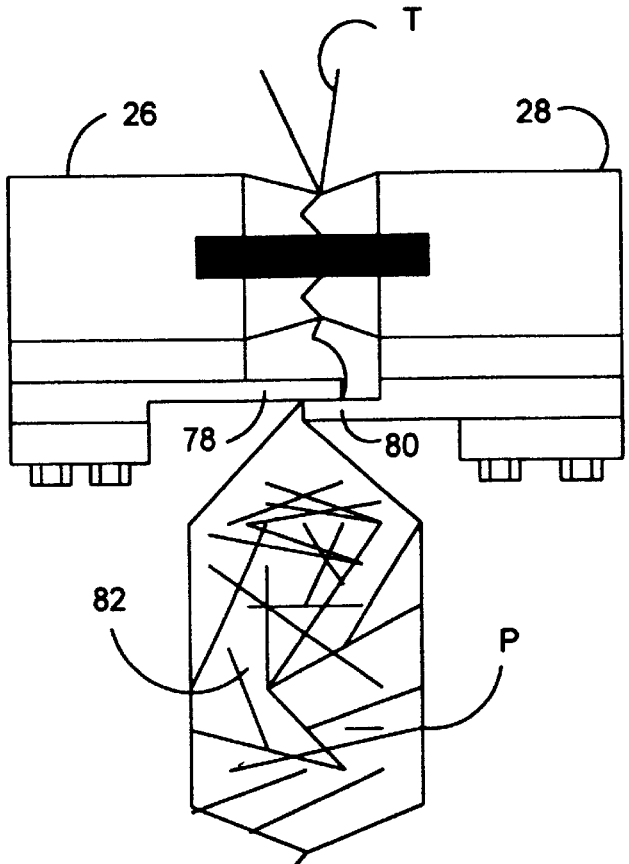

In FIG. 3D, the reverse pull has been completed, and the ultimate size of the package P has been determined. At this point, the sealing jaws 26 and 28 again commence horizontal movement toward one another to fully close the sealing jaws about the collapsed tube T.

In FIG. 3E, the sealing jaws 26 and 28 are fully closed, and sealing of the bottom of the tube T and top of the package P commences. At the same time, the knife assembly 62 is activated to sever the package P from the tube T.

Figure 3F:
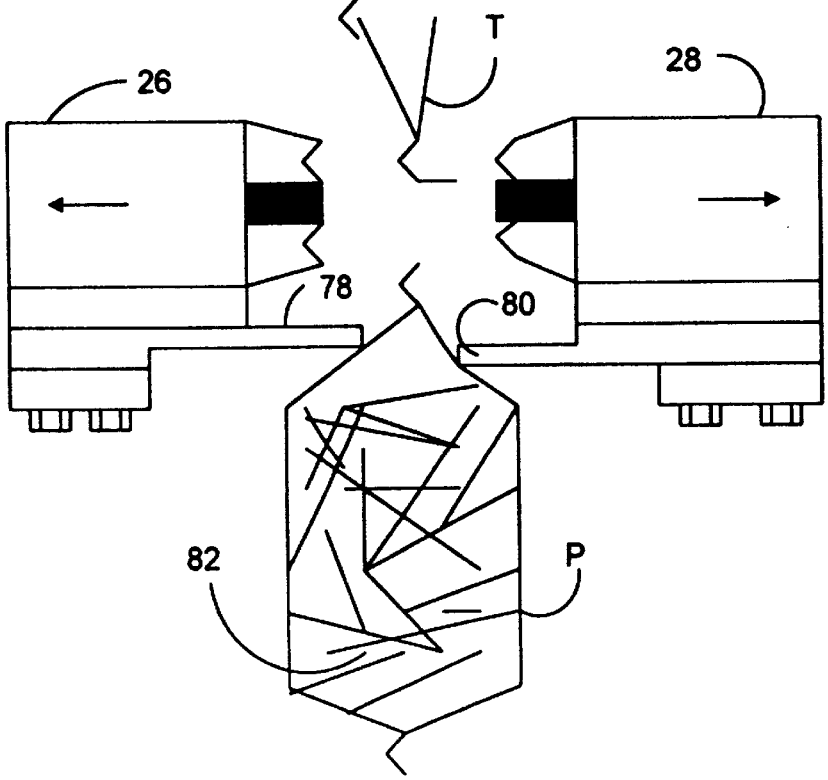

In FIG. 3F, the sealing jaws 26 and 28 have begun to open. The package P falls under the influence of gravity for later collection and handling, and the downward advancement of the tube T is then recommenced, with the process illustrated in FIGS. 3A through 3F then being repeated for each of the packages P produced by the packaging apparatus 10.

The operation illustrated in FIGS. 4A through 4F is similar to that of FIGS. 3A through 3F, but in relation to a continuous motion packaging apparatus 10 in which the tube T always advances downwardly, and the motion of the pull belts 36 and 38 is not halted or reversed. In this form of the invention, the sealing jaws 26 and 28 are mounted for both horizontal movement as well as vertical movement, as described below.

Figure 4A:
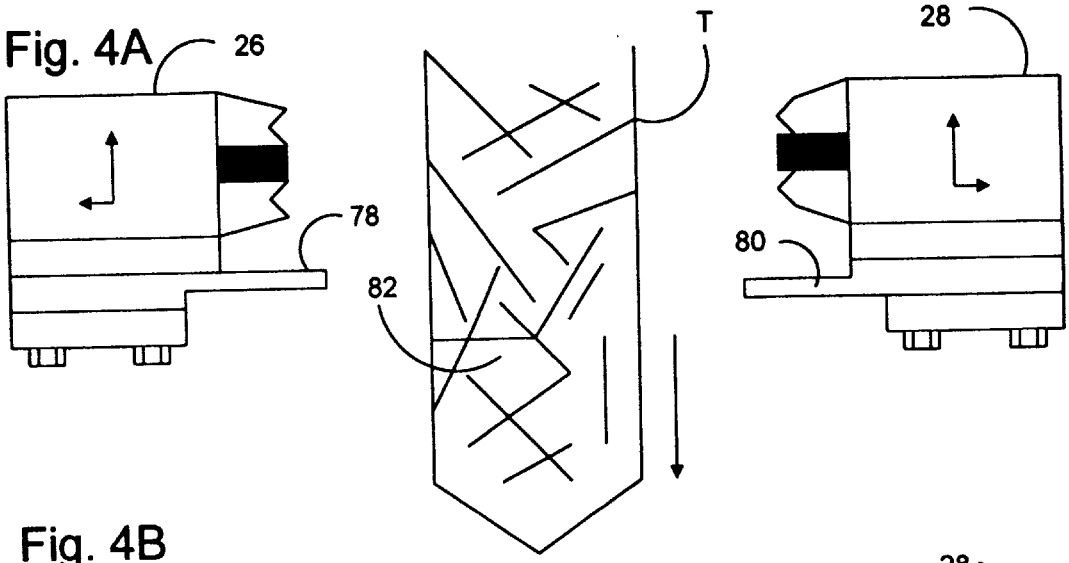
FIGS. 4A through 4F illustrate the various steps of filling, stripping, sealing and severing a package in a continuous motion machine in which the film tube is continuously traveling in the forward direction.

In FIG. 4A, the sealing jaws 26 and 28 are fully open, and the tube T is progressing downwardly, while having been or being filled with the product 82. The sealing jaws 26 are either stationary, or still returning to their uppermost and opened positions, as illustrated by the arrows in the drawing figure.

Figure 4B:
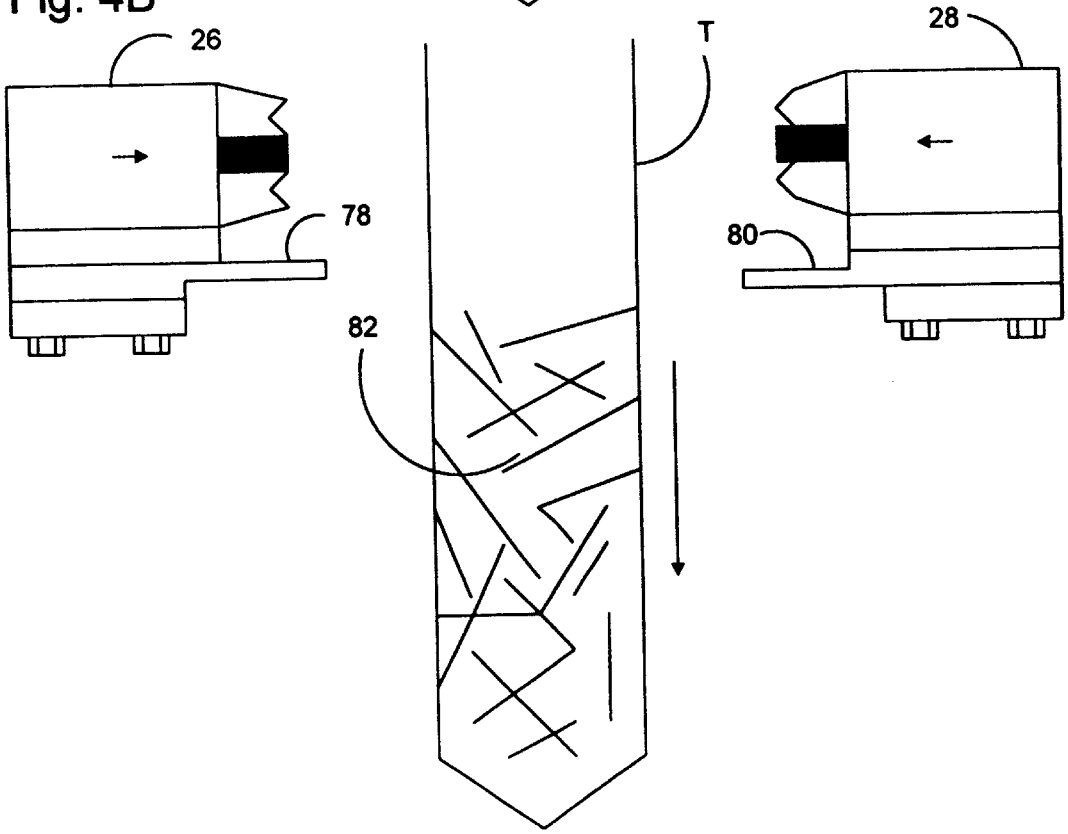

In FIG. 4B, the tube T has advanced a sufficient distance in relation to the positions of the sealing jaws 26 and 28, and the sealing jaws 26 and 28 begin to partially close. At the same time, the sealing jaws 26 and 28 begin to accelerate downwardly so that the engagement portions 78 and 80, when collapsing the tube T, are advancing at a downward velocity greater than that of the tube T.

Figure 4C:
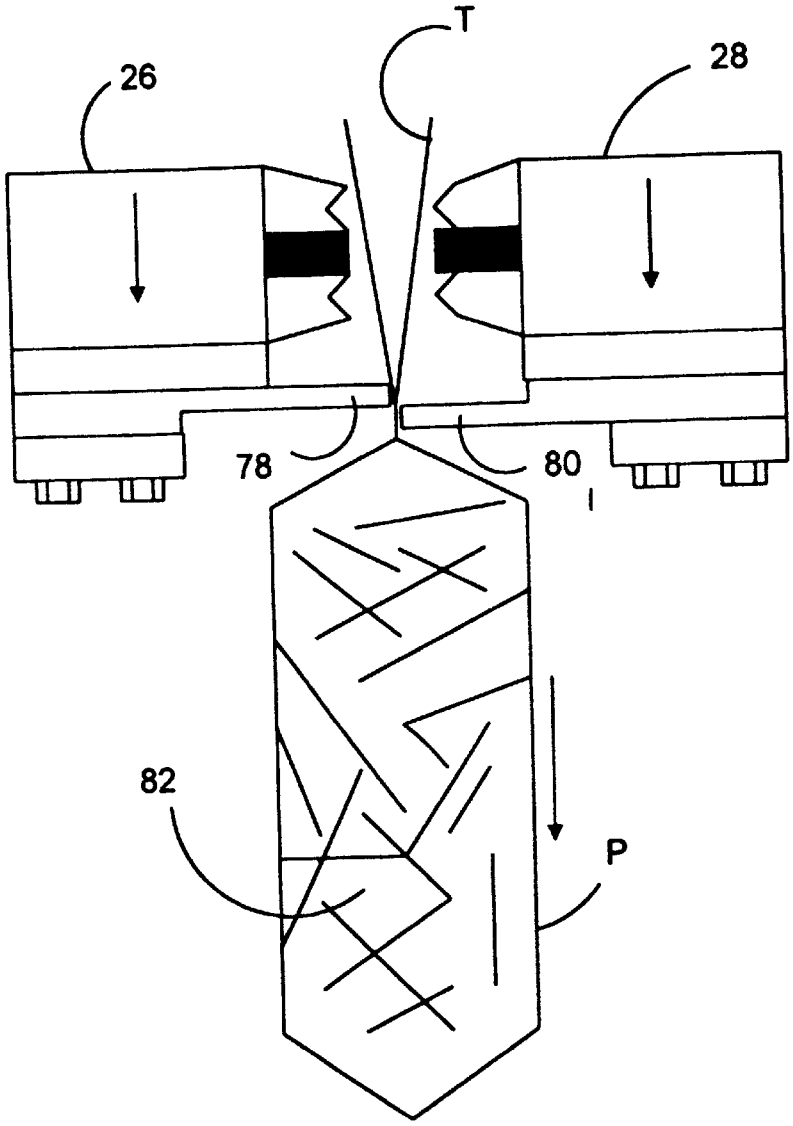

In FIG. 4C, the sealing jaws 26 and 28 have partially closed, with the tube T collapsed between the engagement portions 78 and 80. The downward velocity of the sealing jaws 26 and 28 is greater than that of the tube T, and stripping between the engagement portions 78 and 80 begins.

Figure 4D:
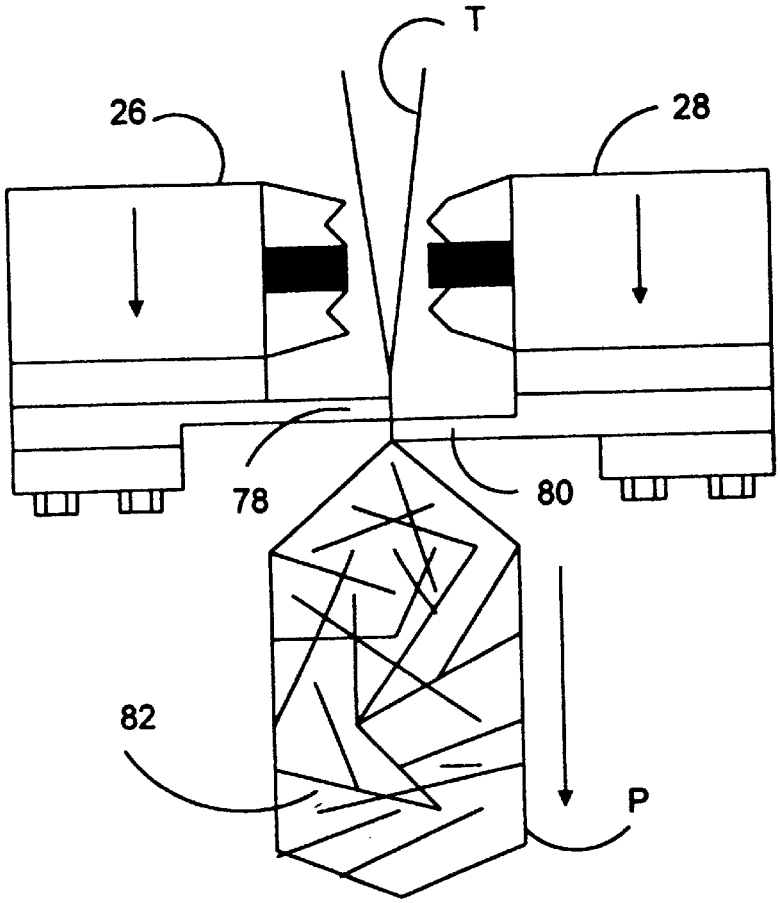
Figure 4E:
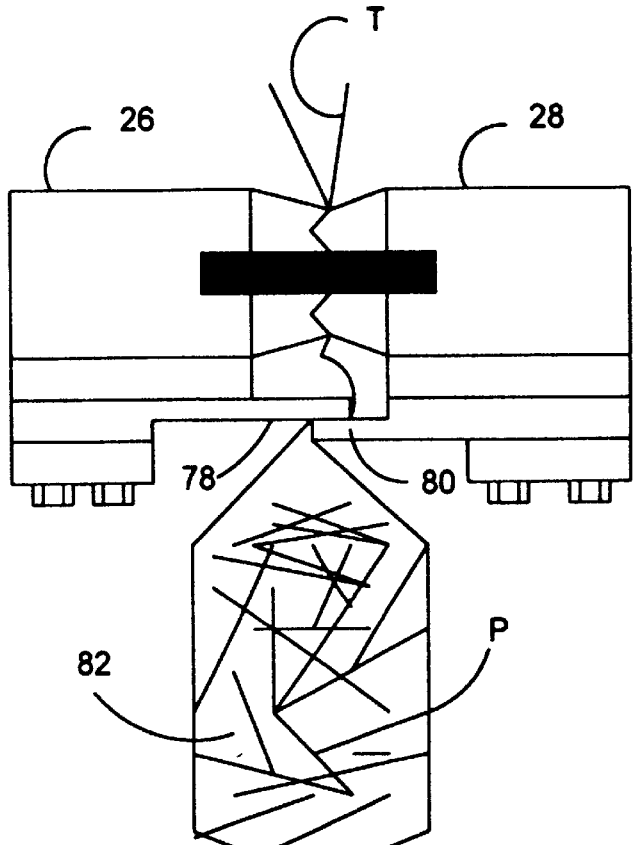

In FIG. 4D, stripping has been completed, and the ultimate size of the package P has been determined. At this point, the downward velocity of the sealing dies 26 and 28 has been slowed to precisely match the downward velocity of the tube T and package P in order to permit sealing and severing. By this time, closing of the sealing jaws 26 and 28 has commenced.

In FIG. 4E, the sealing jaws 26 and 28 are fully closed, and sealing of the end seal of the top of the package P and bottom of the tube T commences. At the same time, the knife assembly 62 is activated to sever the package P from the tube T. The downward velocity of the sealing dies 26 and 28 matches that of the tube T and package P.

Figure 4F:
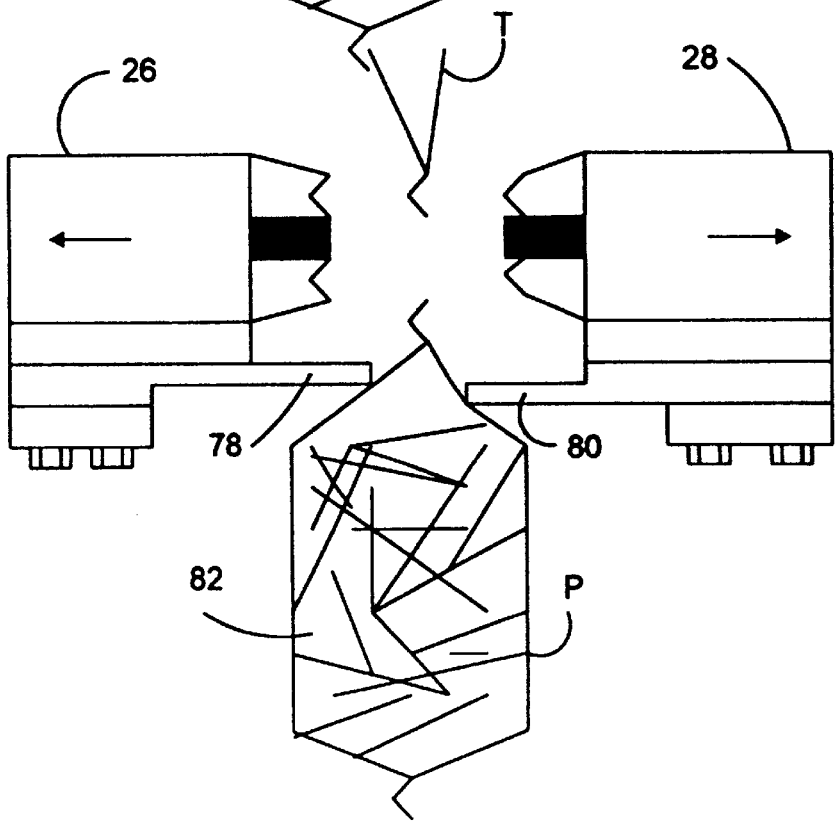

In FIG. 4F, sealing and severing has been completed, and the sealing jaws 26 and 28 begin to open. The package P drops freely under the influence of gravity, and the return movement of the sealing dies 26 and 28 upwardly to the orientation shown in FIG. 4A commences. The process of FIGS. 4A through 4F is then repeated for each succeeding package P prepared by the packaging apparatus 10.

Figure 5:
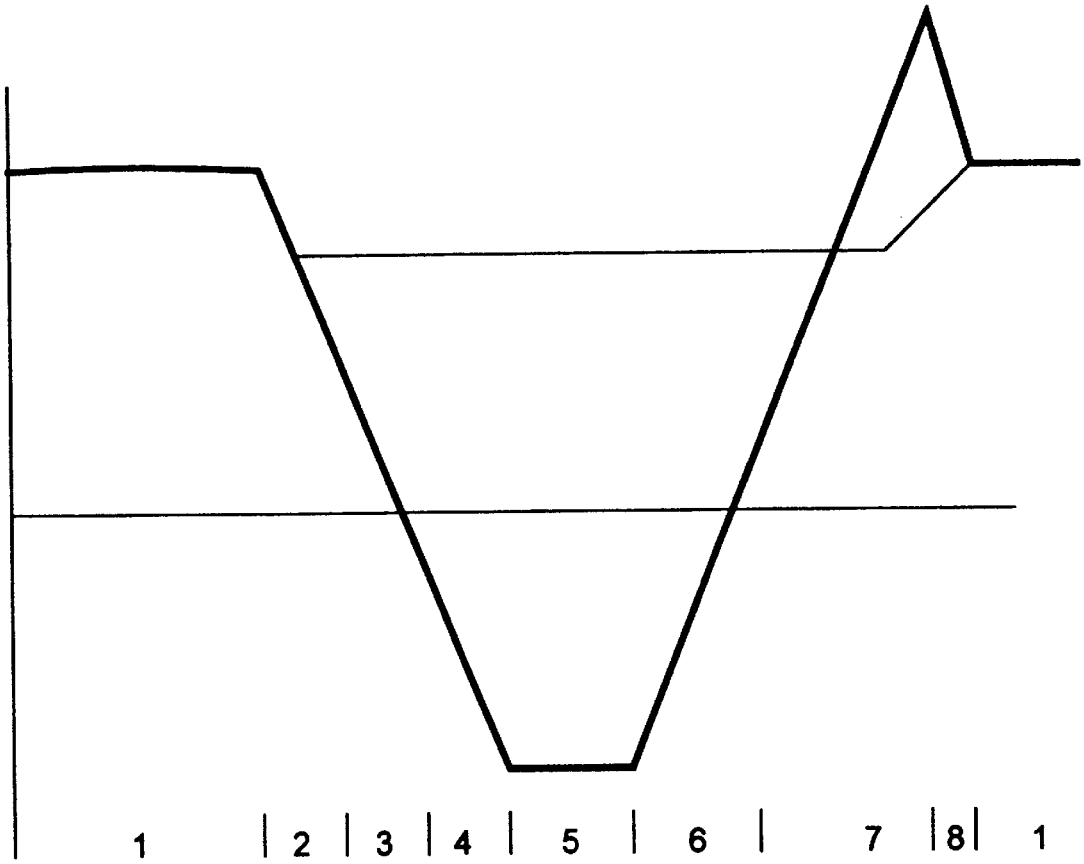
FIG. 5 illustrates a linear motion profile for the process illustrated in FIGS. 4A through 4F.

FIG. 5 depicts the relative motion of the tube T and the sealing jaws 26 and 28 throughout the cycle illustrated in FIGS. 4A through 4F and described above. The cycle can be modified depending on the size of the package P, the productivity speed of the apparatus 10, the opening of the sealing jaws 26 and 28, and other factors. That illustrated in FIG. 5 is typical of a normal cycle of operation.

The invention provides a simple apparatus and process for stripping the end seal area of a packaging machine, whether the packaging machine utilizes reverse stripping, or continuous forward motion. It has no moving parts in the stripping mechanism, and therefore provides extremely dependable operation.

Various changes can be made to the invention without departing from the spirit thereof or scope of the following claims.

What is claimed is:

1. In a vertical form, fill and seal apparatus comprising a source of a web of flexible packaging material, a device for forming the web into a tube, means for pulling the web through the apparatus, and a mechanism for sealing and severing the tube into discrete packages, the mechanism including a pair of sealing jaws spaced on opposite sides of the tube, at least one of the sealing jaws being movable horizontally toward and away from the other sealing jaw, the improvement comprising a. wiper means comprising first and second wiper members, one of said wiper members being secured to each of said sealing jaws and extending toward the tube, each said wiper member having a single tube engagement portion vertically offset from the other said engagement portion, and b. means for relative movement of said wiper means and said tube upon engagement of said wiper members for stripping the tube.

2. A vertical form, fill and seal apparatus according to claim 1, in which each of said wiper members includes an arm having a predetermined length.

3. A vertical form, fill and seal apparatus according to claim 2, in which said arms comprise said engagement portions.

4. A vertical form, fill and seal apparatus according to claim 3, in which said arms are vertically separated from one another by a gap sufficient to accommodate the tube collapsed therebetween when said wiper members are engaged.

5. A vertical form, fill and seal apparatus according to claim 1 in which said means for pulling includes a pair of pull belts engaging said tube and pulling said tube in a forward direction, and said means for relative movement comprises means for reversing said pull belts to pull said tube in a reverse direction.

6. A vertical form, fill and seal apparatus according to claim 1 in which said sealing jaws are movable vertically, and said means for relative movement comprises means for moving said sealing jaws at a greater vertical velocity than the tube.

7. A vertical form, fill and seal apparatus, comprising a. a source of an elongated web of flexible packaging material, b. means for forming the web into a tube, c. means for pulling the web through the apparatus, d. means for sealing and severing the tube into discrete packages, comprising i. a pair of sealing jaws spaced on opposite sides of the tube, ii. means for horizontally moving at least one of the sealing jaws toward and away from the other sealing jaw, e. wiper means comprising first and second wiper members, one of said wiper members being secured to each of said sealing jaws and extending toward the tube, each said wiper member having a single tube engagement portion vertically offset from the other said engagement portion, and f. means for relative movement of said wiper means and said tube upon engagement of said wiper members for stripping the tube.

8. A vertical form, fill and seal apparatus according to claim 7 in which each of said wiper members comprises a flexible arm having a predetermined length.

9. A vertical form, fill and seal apparatus according to claim 8, in which said arms comprise said engagement portions.

10. A vertical form, fill and seal apparatus according to claim 9, in which said arms are vertically separated from one another by a gap sufficient to accommodate the tube collapsed therebetween when said wiper members are engaged.

11. A vertical form, fill and seal apparatus according to claim 7 in which said means for pulling includes a pair of pull belts engaging said tube and pulling said tube in a forward direction, and said means for relative movement comprises means for reversing said pull belts to pull said tube in a reverse direction.

12. A vertical form, fill and seal apparatus according to claim 7 in which said sealing jaws are movable vertically, and said means for relative movement comprises means for moving said sealing jaws at a greater vertical velocity than the tube.

13. A method for stripping and closing a tube in a vertical form, fill and seal apparatus, in which the apparatus includes a source of a web of flexible packaging material, means for forming the web into a tube, means for pulling the web through the apparatus, and means for sealing and severing the tube into discrete packages in which a pair of sealing jaws are spaced on opposite sides of the tube and at least one of the jaws is movable horizontally toward and away from the other jaw, the method comprising the steps of a. providing wiper means on each of the sealing jaws and extending toward the tube, the wiper means comprising first and second wiper members, each said wiper member having a single tube engagement portion vertically offset from the other said engagement portion, b. partially closing the sealing jaws to engage the wiper means with the tube collapsed therebetween, c. moving the wiper means and the tube relative to one another to strip a portion of the tube, d. fully closing the sealing jaws to seal and sever a package from the tube with the engagement portions vertically overlapping one another, and e. opening the sealing jaws to release the package.

14. A method according to claim 13, in which method step "c" comprises maintaining the sealing jaws in a stationary position and pulling the tube in a reverse direction.

15. A method according to claim 13, in which method step "c" comprises moving the sealing jaws vertically at a velocity greater than the tube.

16. A vertical form, fill and seal apparatus according to claim 13, in which each engagement portion comprises an arm, and method step "b" includes partially closing said sealing jaws until said arms have substantially coextensive tips.

17. A vertical form, fill and seal apparatus according to claim 16, in which method step "d" includes overlapping one arm over the other with a gap between the arms sufficient to accommodate the tube collapsed therebetween.

* * * * *